US010731951B2

(12) United States Patent
Jenzowsky et al.

(10) Patent No.: US 10,731,951 B2
(45) Date of Patent: Aug. 4, 2020

(54) METHOD AND APPARATUS FOR REPELLING A DETECTABLE DRONE

(71) Applicant: Atos Convergence Creators GmbH, Vienna (AT)

(72) Inventors: Stefan Jenzowsky, Berlin (DE); Stefan Von Der Heide, Norderstedt (DE)

(73) Assignee: Atos Convergence Creators GmbH, Vienna (AT)

( * ) Notice: Subject to any disclaimer, the term of this patent is extended or adjusted under 35 U.S.C. 154(b) by 0 days.

(21) Appl. No.: 16/287,402

(22) Filed: Feb. 27, 2019

(65) Prior Publication Data

US 2019/0265006 A1 Aug. 29, 2019

(30) Foreign Application Priority Data

Feb. 27, 2018 (DE) ..... 10 2018 202 901

(51) Int. Cl.

| | |
|---|---|
| ***F41H 11/02*** | (2006.01) |
| ***G08G 5/00*** | (2006.01) |
| ***H04K 3/00*** | (2006.01) |
| ***G08G 5/04*** | (2006.01) |

(52) U.S. Cl.

CPC ..... *F41H 11/02* (2013.01); *G08G 5/006* (2013.01); *G08G 5/0008* (2013.01); *G08G 5/0021* (2013.01); *G08G 5/0069* (2013.01); *G08G 5/0078* (2013.01); *G08G 5/045* (2013.01); *H04K 3/43* (2013.01); *H04K 3/90* (2013.01); *H04K 3/92* (2013.01); *H04K 3/42* (2013.01); *H04K 2203/22* (2013.01)

(58) Field of Classification Search

CPC ..... B64C 2201/14; B64C 2201/027; F41H 11/02; H04K 3/92

USPC ..... 455/1, 431, 7, 11.1

See application file for complete search history.

(56) References Cited

U.S. PATENT DOCUMENTS

| | | | | |
|---|---|---|---|---|
| 2015/0254988 | A1 | 9/2015 | Wang et al. | |
| 2016/0328983 | A1* | 11/2016 | Hutchinson | G08G 5/045 |
| 2017/0148332 | A1 | 5/2017 | Ziemba et al. | |
| 2018/0040249 | A1* | 2/2018 | Kuhara | G05D 1/101 |
| 2018/0357909 | A1* | 12/2018 | Eyhorn | B64C 39/024 |

FOREIGN PATENT DOCUMENTS

| | | | |
|---|---|---|---|
| DE | 102015008256 | A1 | 12/2016 |
| DE | 102017201043 | A1 | 7/2018 |
| DE | 102017006877 | A1 | 8/2018 |

OTHER PUBLICATIONS

Search Report for German Patent App. No. 102018202901.6 (dated Jan. 16, 2019).

* cited by examiner

*Primary Examiner* — John J Lee

(74) *Attorney, Agent, or Firm* — Kenealy Vaidya LLP

(57) ABSTRACT

Some embodiments relate to a method for repelling a detectable drone, whose flight control and/or whose drone flight path can be influenced by repulsion measures, wherein a repulsion space is defined as a part of the airspace, and wherein the flight control and/or the drone flight path of a drone located in the repulsion space is influenced.

14 Claims, 3 Drawing Sheets

METHOD AND APPARATUS FOR REPELLING A DETECTABLE DRONE

CROSS REFERENCE TO RELATED APPLICATION(S)

This application claims the priority benefit under 35 U.S.C. § 119 of German Patent Application No. 102018202901.6, filed on Feb. 27, 2018, the content of which is hereby incorporated by reference in its entirety.

BACKGROUND

The presently disclosed subject matter relates to a method and an apparatus for repelling a detectable drone whose flight control and/or whose drone flight path can be influenced by a repulsion procedure.

Drones have become enormously widespread in recent years. This circumstance entails the fact that not only experienced users but also inexperienced persons control drones. This latter point has as a consequence, amongst other things, the result that dangerous situations arise from the lack of experience of the persons and through the faulty assessment of situations.

Some embodiments of the presently disclosed subject matter relate in particular to dangerous situations, the dangerous situations arising through the presence of drones in the region of airfields, landing zones or flying objects. Some embodiments are particularly concerned with the aspect of repelling drones from the locations and/or flying objects.

When a flying object such as, for example, a helicopter is being used for a rescue operation, such an operation of a flying object can take place equally well in an urban area or in a mountain range. In such operations, the flying object can with a high probability fly through regions in which drones are flying. The flying object will, in particular when landing or taking off, fly through airspace levels with a regulated air traffic and with an unregulated air traffic. Drones that represent a danger for the flying object will increasingly be flying in those zones with an unregulated air traffic. A flying object is in particular in danger when drones collide with the flying object and thereby damage one of the many important components of the flying object such as, for example, the propellers of a helicopter.

At the same time, drones can be used in an operation. Drones can, for example, assist the pilot of a helicopter with the control of a flying object in the context of such an operation. The task thus arises of only repelling drones present in the region of a flying object to be secured and/or in the region of a location to be secured to the extent that the necessary safety that may be is established.

Methods and apparatuses by which drones can be repelled from the locations are known to the related art. These methods and apparatuses according to the related art is largely based on the detection and recognition of the drones, the influencing of the drone control by an interfering signal, and on the attacking and/or trapping of the drones.

The company Dedrone (see also www.dedrone.com) is a supplier of drone repulsion systems which are restricted to the recognition of the drones and the output of a signal. These systems are in no way able to ensure that a drone-free region such as, for example, an airfield or a flight path is intact.

Another system is offered by the company Blighter (see also blighter.com). This system combines the method of recognizing a drone and, further, the method of the output of an interfering signal in order to force the detected drone to land.

The dynopsis system is offered by the company Dronedefence (see also www.dronedefence.co.uk/dynopsis-ECM). With this system too an interfering signal is output without any kind of spatial limitation or concentration.

In reference to methods for the output of interfering signals, we refer, for example, to the documents U.S. Pat. No. 8,543,053, US20150302858, and U.S. Pat. No. 9,085,362. The output of interfering signals to influence the control of a drone or of the drone flight path is thus known to the related art.

The methods mentioned above for trapping a drone that is to be repelled include casting a net, firing munitions at the drone, and hunting the drone with further drones that physically capture the drone that is to be repelled and force it to land. The capture of a drone that is to be repelled can also include the use of specially trained animals, birds in particular.

A repulsion measure can accordingly include the output of an interfering signal as described above for influencing the control of the drone and/or the capture of the drone.

An interfering signal can have the effect that a radio signal for controlling the drone is interrupted. The drone can hereby be forced to carry out a prescribed motion.

One of ordinary skill in the art understands that the devices and methods described above by way of example are in no way appropriate for securing a sensitive region such as an airfield, a landing zone, or the surroundings of a flying object or a flying object.

SUMMARY

Some embodiments address in the broadest sense the object of increasing the security of flying objects against drones.

According to some embodiments this is achieved in that a repulsion space is defined as a part of the airspace, wherein the flight control and/or the drone flight path of a drone that is in the repulsion space is influenced.

The repulsion space is a partial, spatial region of the airspace in the surroundings of a region that is to be protected and/or a flying object to be protected. The repulsion space is thus a smaller region than the airspace. The definition of the repulsion space has the effect that the repulsion measures can be concentrated on a smaller region, and thus the effectiveness of the method according to some embodiments can be increased in comparison with the methods according to the related art.

The accuracy of the repulsion of the drones to be repelled is increased through the method according to some embodiments. The repulsion space can be chosen, as presented below, such that it extends over those regions in which a drone would represent a genuine danger for the flying object or the location to be secured.

The repulsion zone can be defined depending on a flying object located in the airspace, wherein the flying object is to be protected from the drone.

A flying object can, for example, be an aircraft, a helicopter, an airship or a similar flying object, the flying object being suitable for the transport of persons or goods. The repulsion zone can be selected such that a region around the flying object is kept clear.

The repulsion zone can be selected depending on a flight path of the flying object to be protected as a partial region of the airspace including the flight path.

A flying object has a motion path. When the flying object moves in the airspace, this motion path is a flight path. The flight path can be prescribed or can be determined with reference to the control of the flying object. Both the current flight path and the predicted flight path can be determined here.

One of ordinary skill in the art recognizes that the current flight path and the predicted flight path of a flying object is in particular to be kept free from drones. Following this basic idea, the repulsion zone can be defined depending on the flight path.

The repulsion zone can be defined as a partial region of the airspace that includes the flight path. The one of ordinary skill in the art can here, on the basis of his accumulated experience, select the repulsion zone as a region including the flight path and a security region extending away from the flight path.

The method according to some embodiments can include the detection of the drone flight path of the drone.

As explained at the beginning, the drone can be detected. The detection of the drone can take place at a time point t. A drone flight path can be determined through the detection of the drone at later time points t'. The one of ordinary skill in the art can calculate a drone flight path from the determination of the position of the drone at a plurality of time points.

The repulsion measures can be selected depending on a position of the drone and/or the drone flight path.

For example, various risk scenarios, wherein the risk scenarios necessitate relevant repulsion measures, result depending on the position of the drone with respect to the repulsion zone or to a flying object. The repulsion measures can range from the output of an interfering signal to interfere with the radio signal for control of the drone, through the capture of the drone and on to destruction of the drone.

As presented at the beginning, the method according to some embodiments are based on the repulsion of a drone in a defined repulsion region, wherein various repulsion measures can be applied for this purpose.

The method according to some embodiments can include the observation of the effect of the repulsion measure on the flight path.

The method according to some embodiments can include a signal being output on the detection of a drone in the repulsion zone.

The apparatus according to some embodiments for carrying out a method according to the above description includes at least a module for definition of the repulsion space, a module for the detection of a drone, and a module for carrying out the repulsion measure.

By the modules of the apparatus according to some embodiments referred to, the method explained above can be carried out in partial steps.

A module for the detection of a drone can, for example, be a radar or an ultrasonic sensor.

The apparatus according to some embodiments can include a module for the definition of the flight path.

The apparatus according to some embodiments can include an interface to the flying object control of the flying object. With the help of this interface, the flight path of the flying object, in particular the past flight path and the predicted flight path of the flying object, can be determined more easily.

The apparatus can furthermore include a module for the identification of a drone and, where appropriate, a database.

In an advantageous embodiment, the apparatus according to some embodiments includes a module for the control of the repulsion procedure by a user. It is ensured in this way that a user can intervene in the method according to some embodiments at any time.

The module for carrying out the repulsion measure can be suitable for outputting an interfering signal.

The radio connection from the drone controller to the drone can be influenced through the output of the interfering signal. The influencing can take place in such a way that the control of the drone is performed by the interfering signal, or that the radio signal is interrupted. In the event of an interruption of the radio signal, the controller of the drone switches to an automatic control, whereby the drone changes over to a landing motion.

The apparatus includes an interface to the flying object controller of the flying objects, whereby the flight path is recognized.

The apparatus according to some embodiments preferably or advantageously includes a module for control of the repulsion measure by a user. This module continuously gives the user the possibility of intervening in the repulsion of a detected drone and of controlling it. The user further has the possibility of directing the repulsion of a drone himself.

Some embodiments are explained in more detail with reference to the following figures for the sake of better understanding.

BRIEF DESCRIPTION OF THE DRAWINGS

Here, in greatly simplified, schematic form in each case.

DETAILED DESCRIPTION OF EXEMPLARY EMBODIMENTS

It should first be clarified that in the different forms of embodiment described, the same parts are given the same reference signs or the same component identifiers, while the disclosures contained in the entire description can be applied analogously to the same parts with the same reference signs or the same component identifiers. The statements of orientation chosen in the description such as, for example, up, down, to the side etc. refer to the figure immediately being described or illustrated, and these orientation statements are to be transferred analogously to the new orientations when there is a change in orientation.

Figure 1:
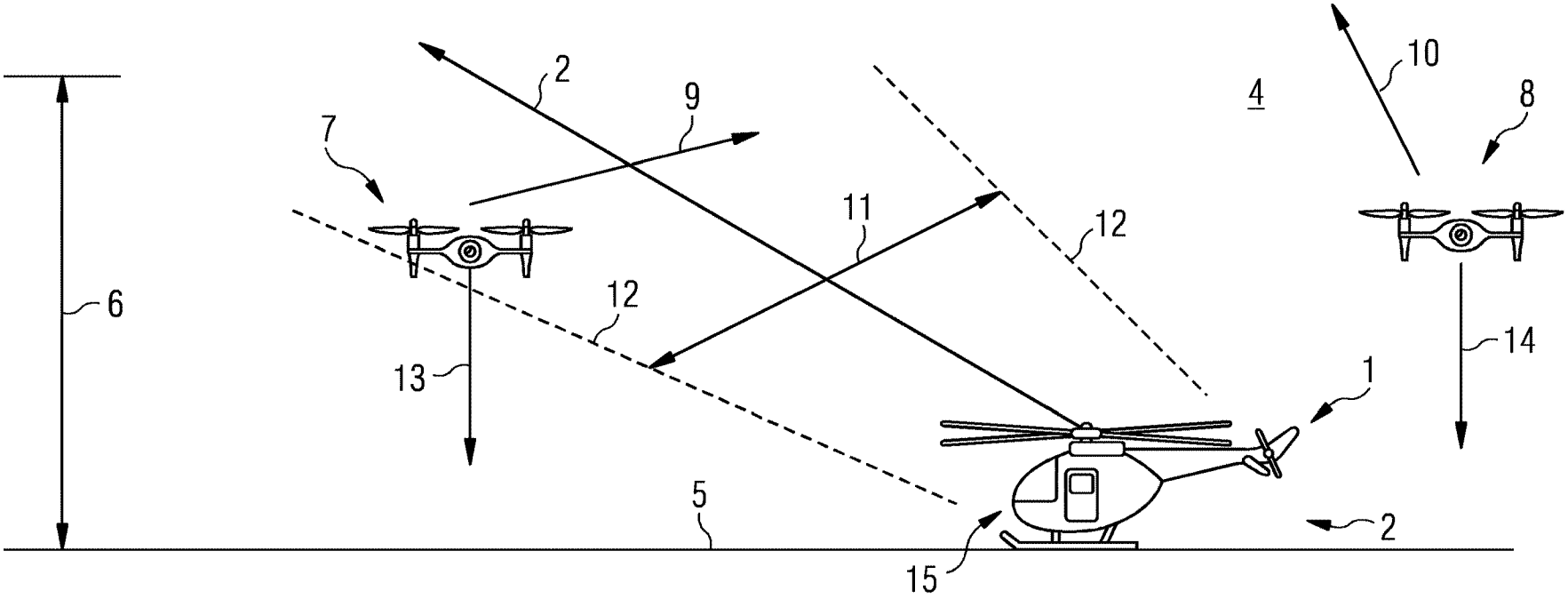
FIG. 1 shows a possible application of the method according to some embodiments and of the apparatus according to some embodiments for securing a helicopter.

FIG. 1 shows a possible application of the method according to some embodiments. A helicopter 1, as a flying object, is ready to take off from a stationary position 2 on the ground 5. The helicopter 1 will adopt a flight path 3 when taking off, the flight path 3 having an angle of about 30 degrees in the exemplary embodiment illustrated in FIG. 1.

It is the aim of the application of the method according to some embodiments to ensure a secure take-off of the helicopter 1, wherein the helicopter 1 must or should cross an airspace level 6 with unregulated air traffic. The airspace level 6 with unregulated air traffic is entered on FIG. 1. A first drone 7 and a second drone 8 are flying in this airspace level 6.

The drones 7, 8, can be detected with conventional methods. In the form of embodiment illustrated in FIG. 1, the method according to some embodiments are thus characterized in that the drones 7, 8 that are located in the airspace level 6 are detected. The drone flight paths 9, 10 can be influenced through suitable repulsion methods according to the related art.

According to the description of the method according to some embodiments, a repulsion zone 11 is defined, where the repulsion zone 11 is represented in FIG. 1 by two dashed boundary lines 12. The expert, with the aid of his experience, defines the width of the repulsion zone 11 symbolized by the boundary lines 12. The one of ordinary skill in the art here takes into account, for example, the size of the helicopter 1 and the airflows caused by the helicopter 1 as well as other possible further airflows. The width of the repulsion zone 11 is, furthermore, selected in a manner that is scaled by a safety factor.

The repulsion zone 11 is a part of the airspace 4 or of the airspace level 6. The first drone 7 located in the repulsion zone 11, with a first, predicted drone flight path 9, represents a danger for the helicopter 1 taking off. This danger arises in particular in that the flight path 2 of the helicopter 1 and the first drone flight path 9 intersect one another, which is to be evaluated as an indication of a collision.

The repulsion zone 11 is thus defined depending on the flight path 2, in order to avoid a collision between the helicopter that is taking off and a drone.

The first drone flight path 9 of the first drone 7 is influenced by repulsion measures according to the related art. In the exemplary application illustrated in FIG. 1, the radio signal to the first drone 7 is interrupted, whereby the automatic control of the first drone 1 takes over and the first drone 7 changes over to a first landing motion 13.

The second drone 8 is also located in the airspace level 6, but outside the repulsion zone 11. The predicted second drone flight path 10 crosses neither the repulsion zone 11 nor the flight path 2. Even in the case of a second landing motion 14 of the second drone 8, which would be initiated by an interruption of the radio contact to the second drone 8, the second drone 8 would not cross the repulsion zone 11, so that the second drone 8 does not represent a danger, even in this unusual situation.

The method according to some embodiments is thus characterized in that the drone flight paths 9, 10 of the drones 7, 8, as well as the landing motion 14, are detected as a possible drone flight path.

The method according to some embodiments further includes the output of a signal on the detection of the first drone 7 in the repulsion zone 11. The signal is output in the helicopter 1, whereby the pilot of the helicopter 1 receives a warning of the first drone 7, the first drone 7 being located in a danger region defined by the repulsion zone 11. The method according to some embodiments is characterized in that a signal is only output when a drone represents a danger, as is illustrated by the first drone 7 in FIG. 1.

If a signal is also output because a drone such as the second drone 8 is present in the airspace level 6, then it is possible that after a number of false indications of a danger to the helicopter, the pilot would disregard such a signal. The method according to some embodiments is thus characterized in that the user only receives a signal when there is a risk to the helicopter 1. The evaluation of the risk takes place here through a clear definition, namely the presence of the first drone 7 in the repulsion region.

An apparatus according to some embodiments is arranged at the helicopter 1, the apparatus including at least a module for the definition of the repulsion space, a module for the detection of a drone and a module for carrying out the repulsion measure.

With the aid of the module for detecting a drone, the first drone 7 is detected, the first drone being located in the defined repulsion zone 11. In the form of embodiment of the method according to some embodiments illustrated in FIG. 1*i*, the second drone 8, located outside the repulsion zone 11, is also detected. The module for the detection of the drone here is a radar.

An interfering signal, aimed into the repulsion zone 11, is output by the module for carrying out the repulsion measure.

The definition of the repulsion zone 11 thus makes it possible that the second drone 8 that is located outside the repulsion zone 11 is not detected, and is furthermore not unnecessarily repelled by an interfering signal.

The apparatus according to some embodiments for carrying out the method described above and illustrated in FIG. 1 includes a module for the definition of the repulsion space, a module for the detection of a drone, and a module for carrying out the repulsion measure.

The apparatus 15 according to some embodiments is—as illustrated in FIG. 1—part of a helicopter. FIG. 1 relates in particular to the special case in which the apparatus according to some embodiments is arranged on the helicopter 15 and thus on the flying object that is to be protected.

The repulsion zone 11 is defined of the module for defining the repulsion zone 11. The definition of the repulsion zone 11 represents a step, internal to the method, which does not necessarily have to be visible to the user of the method. The boundary lines 12 entered in FIG. 1 are only entered in FIG. 1 for reasons of illustration. The method according to some embodiments can include the illustration of the defined repulsion zone 11 on a map or on an operating element of the helicopter as the flying object 15 to be protected. The pilot of the helicopter 15 can adjust the size of the repulsion zone 11.

The apparatus 15 according to some embodiments further includes a module for the detection of drones 7, 8. This module can be restricted to the detection of drones 7 in the repulsion zone 11, or can enable the detection of drones 7, 8 in the airspace 4. The pilot can switch between these functions, even though, in principle, only detection of drones 7 in the repulsion zone 11 is may be necessary for carrying out the method according to some embodiments.

The module for the detection of drones 7, 8 is a radar.

The apparatus according to some embodiments further includes a module for carrying out repulsion measures according to the related art. The module shown in FIG. 1 outputs an interfering signal to interrupt the radio control of the drone 7, so that the drone 7, in the absence of a control signal, changes over to the landing motion 13. The module for carrying out repulsion measures only transmits this interfering signal into the repulsion zone 11 in order to repel the first drone 7 that is present there.

The apparatus 15 according to some embodiments includes a module for the definition of the flight path, the module essentially being coupled to the apparatuses for position determination and/or for control of the helicopter 15. The apparatus 15 according to some embodiments thus includes an interface to the flying object control of the helicopter 15.

The apparatus 15 according to some embodiments further includes a module for the identification of a detected drone 7, 8, wherein drone data are detected and these drone data are compared with a database.

The apparatus 15 according to some embodiments further includes a control module for control of the method according to some embodiments by a user. This control module can include the alignment, mentioned above, of the repulsion space 11 or of the boundary lines 12 of the repulsion space 11, or the input of an air level with an unregulated airspace 11 (to be expected).

The apparatus 15 according to some embodiments in particular includes a module for control of the repulsion measure by a user. With this, the user can stop a repulsion measure against a drone or activate one.

Figure 2:
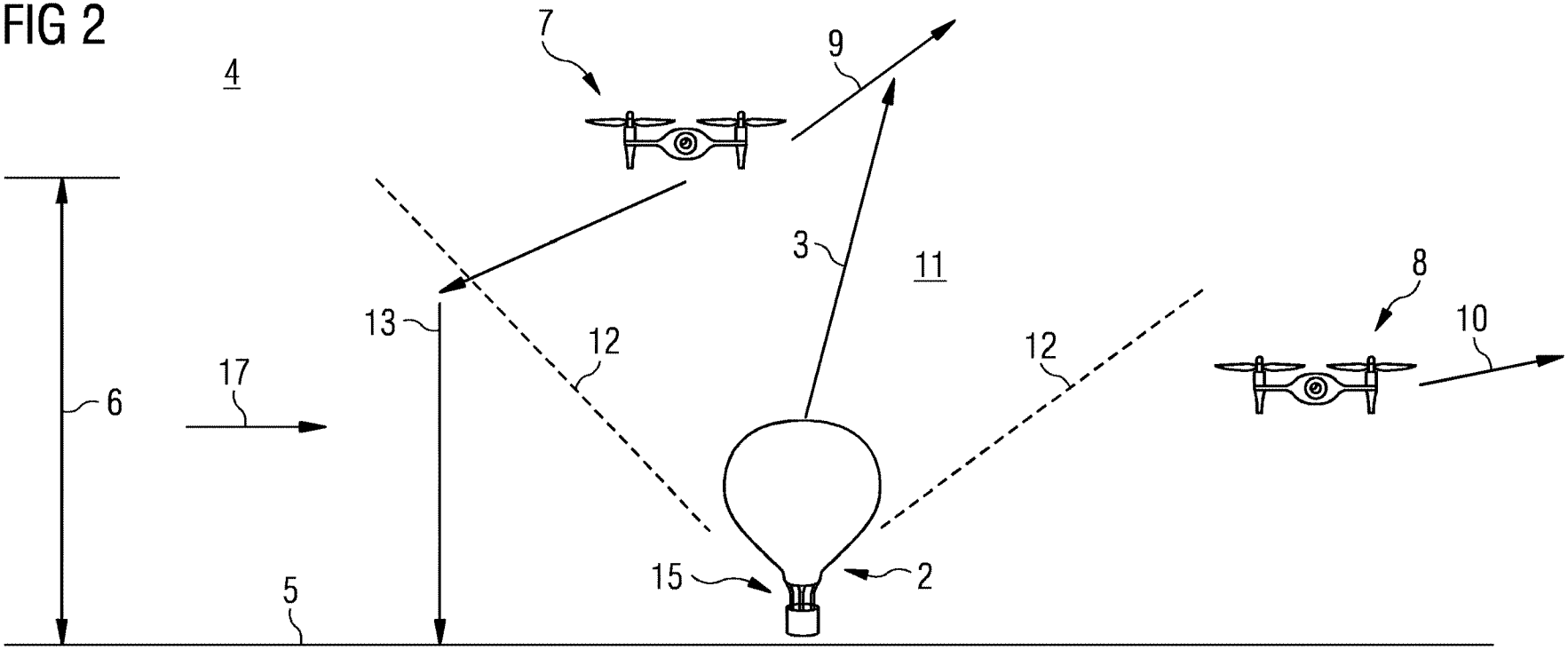
FIG. 2 shows a further possible application of the method according to some embodiments for securing a hot-air balloon.

FIG. 2 illustrates the application of the method according to some embodiments for securing a flight of a hot-air balloon 16 as the flying object. FIG. 2 shows the hot-air balloon 16 immediately before taking off.

According to the conventional understanding, the flight path 2 is determined by the effect of the heated gases trapped in the hot-air balloon 16 and by the wind, the wind blowing in a wind direction 17. Since the wind direction 17 cannot be determined, and is only predictable to a certain extent, the flight path 2 cannot be predicted exactly. The flight path 2 to be assumed is entered on FIG. 2.

In the light of the not exactly predictable flight path 2, the repulsion zone 11 is to be chosen correspondingly large. The boundary lines 12 are spaced significantly further apart than is shown in FIG. 1.

The method according to some embodiments is again based on the detection of drones, where, in the form of embodiment illustrated in FIG. 2, only the first drone 7 located in the repulsion space 11 is detected, and not the second drone 8 located outside the repulsion space 11. The method according to some embodiments in the form of embodiment illustrated in FIG. 2 is thus limited to the detection of drones in the repulsion space, whereby the effectiveness is increased.

The first drone 7 is subjected to an interfering signal, so that the first drone 7, instead of following a first drone flight path, switches over to a first landing motion 13, wherein the first landing motion 13 is controlled by the interfering signal in such a way that the first drone 7 leaves the repulsion zone 11 by the shortest route.

An apparatus 15, preferably or advantageously portable, according to some embodiments is arranged according to the above description in the hot-air balloon 16.

Figure 3:
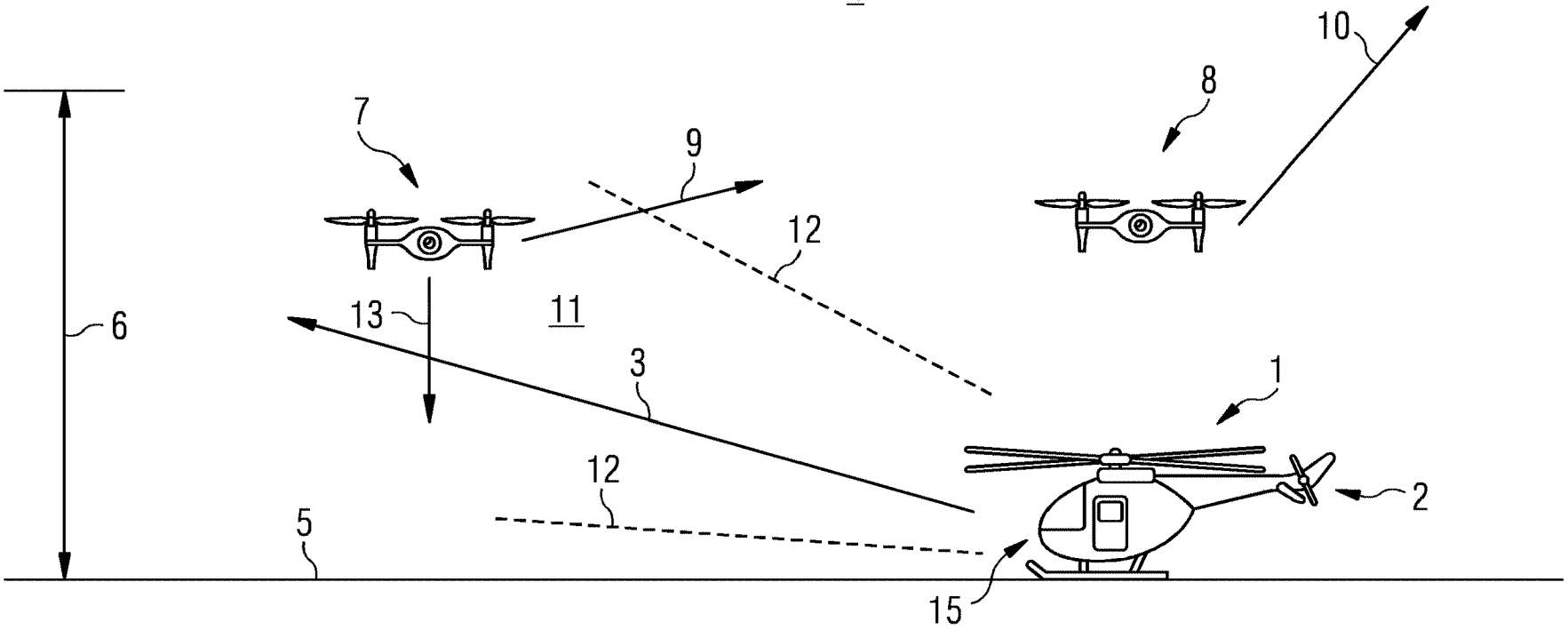
FIG. 3 shows a further possible application of the method according to some embodiments for securing a helicopter.

FIG. 3 illustrates a further form of embodiment of the method according to some embodiments for securing a helicopter 1 that is taking off. The helicopter 1 starts from a stationary position 2 with a flight path 3 having a shallow gradient. A repulsion zone 11 is in turn defined depending on the flight path 2, the repulsion zone 11 being bounded by the boundary lines 12 entered on FIG. 3.

The drones 7, 8 are, furthermore detected. The first drone flight path 9 of the first drone 7 located in the repulsion zone 11 is modified by an interfering signal to a landing motion 13, so that the first drone 7 leaves the repulsion zone 11 as quickly as possible.

The second drone 8, which has also been detected, cannot be further considered when applying the method according to some embodiments, although the second drone 8 is flying immediately above the helicopter. The second drone 8 does not represent a risk to the helicopter, since the second drone 8 is not located in the repulsion zone 11.

The second drone 8 is a drone that is being employed in the context of an operation. The second drone 8 is a reconnaissance drone. Since the method according to some embodiments allow the second drone flight path 10 not to be interfered with by an interfering signal without presenting a danger to the helicopter 1, the use of the second drone 8 is not hindered.

The invention claimed is:

1. A method for repelling a detectable drone whose flight control and whose drone flight path is configured to be influenced by repulsion measures, the method comprising:

defining a repulsion zone as a part of the airspace in the surroundings of a flying object located in the airspace and which is to be protected from the drone; and influencing the flight control and/or the flight path of a drone located in the repulsion space by at least one repulsion measure.

2. The method according to claim 1, further including:

defining the repulsion zone as a partial region of the airspace around the flying object that is to be protected from the drone.

3. The method according to claim 1, further including:

defining the repulsion zone as a partial region of the airspace including the flight path of the flying object that is to be protected from the drone.

4. The method according to claim 1, further including:

detecting the drone flight path of the drone; and, selecting the repulsion measure depending on the drone flight path.

5. The method according to claim 1, further including:

selecting the repulsion measure depending on a position of the drone with respect to the repulsion zone or to the flying object.

6. The method according to claim 1, further including capturing the effect of the repulsion measure on the drone flight path.

7. The method according to claim 1, further including outputting a signal by the flying object on the detection of a drone in the repulsion zone.

8. An apparatus for carrying out the method according to claim 1, the apparatus being configured to be arranged in a flying object located in the airspace and which is to be protected from a detectable drone whose flight control and/or whose drone flight path is configured to be influenced by repulsion measures, the apparatus comprising:

a module for definition of the repulsion zone, a module for detection of a drone, and a module for carrying out the repulsion measure.

9. The apparatus according to claim 8, further including:

a module for the definition of the flight path.

10. The apparatus according to claim 8, further including:

a module for the identification of a drone and, if relevant, a database.

11. The apparatus according to claim 8, further including:

a control module for controlling at least one of the defining and influencing steps.

12. The apparatus according to claim 8, wherein:

the module for carrying out the repulsion measure is suitable for outputting an interfering signal.

13. The apparatus according to claim 8, further including:

an interface to the flying object control of the flying object.

14. The apparatus according to claim 8, further including:

a module for control of the repulsion measure by a user.

* * * * *